United States Patent [19]

Donovan

[11] 4,169,534

[45] Oct. 2, 1979

[54] GARMENT HANGER

[76] Inventor: Marion Donovan, 850 Park Ave., New York, N.Y. 11021

[21] Appl. No.: 925,967

[22] Filed: Jul. 19, 1978

[51] Int. Cl.[2] ..... A47F 7/19

[52] U.S. Cl. ..... 211/113; 223/91

[58] Field of Search ..... 211/113, 119, 118, 46, 211/162; 223/96, 91; 24/137 A, 83, 253; 248/316 B, 316 A

[56] References Cited

U.S. PATENT DOCUMENTS

| | | | |
|---|---|---|---|
| 428,085 | 5/1890 | Friedmann | 211/113 X |
| 2,271,941 | 2/1942 | Kemmitt | 211/119 X |
| 2,279,934 | 4/1942 | Wisecup | 24/137 A X |
| 2,333,178 | 11/1943 | Hoos | 24/253 |
| 2,580,193 | 12/1951 | Richterkessing | 211/113 |
| 2,675,130 | 4/1954 | Dore | 211/119 X |
| 2,851,167 | 9/1958 | Rosenberg | 211/46 |
| 3,214,031 | 10/1965 | McCauley | 211/71 |
| 3,978,988 | 9/1976 | Friedeberg | 211/113 |

FOREIGN PATENT DOCUMENTS

| | | | |
|---|---|---|---|
| 200804 | 6/1920 | Canada | 211/118 |
| 204220 | 7/1939 | Switzerland | 211/113 |

*Primary Examiner*—Roy D. Frazier
*Assistant Examiner*—Robert W. Gibson, Jr.
*Attorney, Agent, or Firm*—Thomas E. Tate

[57] ABSTRACT

The disclosure is that of an invention directed to a garment hanger in which a multiplicity of garments, such as pants, are suspended, waist down, from a normally horizontal frame that is suspended in a clothes closet in such a manner that the leg bottoms or cuffs are completely visible for selection and extraction of a single pair and in such a manner that a pair of pants to be hung can be attached at the front of the hanger unit while sliding any other pairs of pants toward the rear thereof.

8 Claims, 4 Drawing Figures

GARMENT HANGER

THE INVENTION

This invention relates generally to new and useful improvements in garment hangers and particularly seeks to provide a novel hanger for pants, slacks, shorts or the like in which a multiplicity of the garments are suspended, waist down, from a normally horizontal frame that is dependably supported in a clothes closet in such a manner that the leg bottoms or cuffs are completely visible for selection and extraction of a single garment and in such a manner that a pair of pants or other garment to be hung can be attached at the front of the hanger unit while sliding any other garments toward the rear of the hanger unit.

It is recognized that, heretofore, many different types of hangers for various types of garments have been developed but none is believed to provide the versatility of garment inspection, extraction and replacement as does the hanger unit described and claimed herein.

For example, U.S. Pat. Nos. 2,589,564, 2,488,903 and 2,067,833, all show either door or wall mounted, cantilevered, hangers in which there is no provision for sliding the remaining garments from front to rear after an intermediately located garment has been removed, thus leaving space at the front for any additional garments without having to insert any such additional garments into the middle of those remaining on the hanger. Further, the use of slidable spring clips in any such prior devices to maintain each garment under proper spacing and tension along the support line has been observed to be disadvantageous because either the spring clips tend to creep along their support wires if too loose or, if too tightly mounted upon their support wires, cannot be readily adjusted to the span required for the proper suspension of the garment to be hung. Still further, none of the above types of prior known hangers are constructed and proportioned in such a manner as to be readily transferable, together with their supported or hung garments, from a supporting rod in a clothes closet to a suitcase for travel purposes.

In contrast, the hanger unit of this invention comprises a simple sling or strap-supported horizontal rectangular open frame that includes a multiplicity of rigid, spaced parallel, small diameter wires or rods, each adjacent pair of which selectively is adapted to slidably support one or more freely removeable spring-biased clips that are used in laterally spaced pairs or groups to properly grip the bottoms of the legs of each pair of pants to be suspended therefrom for storage purposes.

Therefore, an object of this invention is to provide a novel pants hanger or the like that is capable of storing a multiplicity of such garments in parallel relation in such a manner that an interiorly positioned garment can be readily visually located and removed, and in such a manner that any garments to the front of the removed garment may be slid rearwardly, thus closing the space previously occupied by the removed garment and providing space at the front of the hanger for the unobstructed suspension of any replacement garments.

Another object of this invention is to provide a garment hanger of the character stated that includes a sling-supported horizontal open frame provided with a multiplicity of spaced parallel rigid wires or rods oriented normal to the plane of the bottoms of the pants or other garments to be suspended, each adjacent pair of such wires or rods being adapted to slidably support one or more freely removable spring-biased clips that are used in laterally spaced pairs or groups to properly grip the bottoms of the legs of each pair of pants to be suspended therefrom for storage purposes.

Another object of this invention is to provide a garment hanger of the character stated in which the parallel wires of the horizontal frame are spaced just sufficient to freely receive the spring-biased clips and in which the clips are constructed for sliding and pivotal support upon the upper surfaces of the associated wires.

A further object of this invention is to provide a garment hanger of the character stated in which the sling for the support of the horizontal frame is flexible and is adapted to be removably attached to any suitable support, such as a rod in a clothes closet, in such a manner that the parallel wires of the horizontal frame are oriented at a right angle to the axis of the closet rod.

A further object of this invention is to provide a garment hanger of the character stated that is simple in design, rugged in construction and economical to manufacture.

With these and other objects, the nature of which will become apparent, the invention will be more fully understood by reference to the drawings, the accompanying detailed description and the appended claims.

Figure 1:
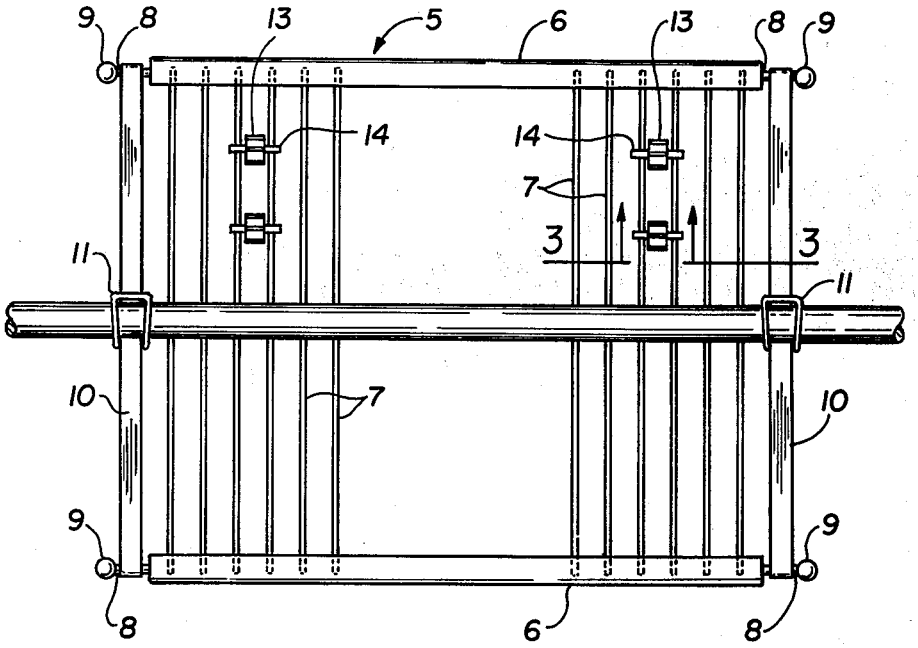
FIG. 1 is a top plan view of a garment hanger constructed in accordance with this invention.
Figure 2:
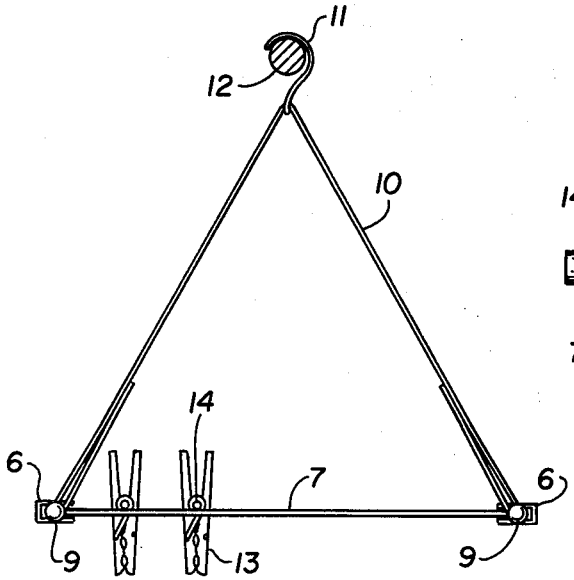
FIG. 2 is a right end elevation thereof.
Figure 3:
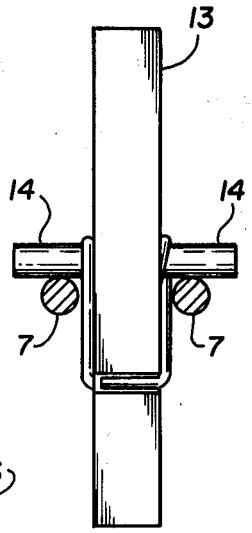
Figure 4:
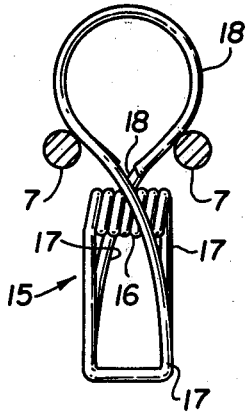

FIG. 3 is an enlarged detail longitudinal section taken along line 3—3 of FIG. 1 and particularly shows the manner in which one form of spring-biased clothes clip is supported between and by any selected pair of the spaced parallel rods of the frame; and FIG. 4 is a view similar to FIG. 3 but showing a differently constructed clip that is formed entirely from spring wire and that does not require the transverse supporting pin of the clip of FIG. 3.

Referring to the drawings in detail the invention, as illustrated, is embodied in a garment hanger that includes a rigid horizontal rectangular frame generally indicated 5 comprising a pair of spaced parallel side rails 6, 6 that are spanned by a multiplicity of rigid, spaced parallel, garment-supporting rods 7 having their ends affixed to or within the side rails.

Studs 8, having end abutments 9, extend longitudinally from the ends of the side rails 6 and serve as anchors for a pair of chains or flexible hanging straps or slings 10, 10 that are adjustably secured to the studs in order that the effective lengths of the slings may be varied as needed to obtain a proper setting of the frame 5 below a clothes rod from which it is to be suspended.

Each sling 10 is provided with a wire hook 11 located at the mid-point thereof and adapted to fit over the usual horizontal clothes rod 12 to horizontally support the frame 5 any desired distance therebelow as determined by the adjusted lengths of the slings.

Garments to be stored on this hanger unit, particularly pants, slacks or shorts, are hung entirely beneath the frame 5 and are each suspended therefrom by at least a pair of spring-biased clips 13, 13, each of which fits downwardly between a selected pair of the spaced parallel rods 7 and is supported on the tops of the rods by oppositely extending transverse studs or trunnions 14, 14.

Conveniently, and for economy of construction, the clips 13 may be the standard, commercially available, wooden or plastic spring-biased clothes pins simply modified by inserting short dowels or rods through the centers of the cylindrical biasing springs so that the projecting ends of the dowels serve as the studs or trunnions 14.

However, for simplicity as well as economy and reduction in height, it may be preferable to use clips of all-wire construction such as shown in FIG. 4 of the drawings.

There, a clip, generally indicated 15, is formed from a continuous length of spring wire of circular cross-section and includes, a transverse cylindrical coil spring 16 having a length to pass freely but closely between a pair of the parallel rods 7. The ends of the spring 16 are sufficiently long to be bent into configurations defining a pair of generally U-shaped depending clamp arms 17 and a pair of upwardly projecting pinch rings 18, the diameters of which are sufficiently greater than the spacing between the rods 7 as to permit the pinch rings to be supported by the rods when the clip 15 is fitted downwardly therebetween.

In use, and as viewed in FIG. 1 of the drawings, for each pair of pants to be hung (waist down) a pair of the clips 13 or 15 are inserted between selected pairs of rods 7 at a distance apart properly to span the width of the bottoms of the pant's legs and the leg bottoms are then secured by the clips, thereby both freely suspending the pants and maintaining the bottoms under uniform tension because the clips cannot move either toward or away from each other.

The first pair of pants should be hung directly under the closet rod 12 and succeeding pairs should be hung in front of the first pair and the first pair should be slid back along the rods 7 to maintain proper balance.

Now, assuming that the hanger unit is at least partly or fully filled, selection of any internally located pair of pants can be made visually simply by looking down over the top of the frame and extracting the selected pants by smartly pulling that pair down against the frictional resistance of the clips, at which time the released clips are removed from the top of the frame 5 and clipped to the slings 10 for future use. Further, when the released clips are removed, thus providing space for another pair of pants, any pair or pairs of pants in front of the location of the removed pair are slid rearwardly along the rods 7, thus providing space at the front of the hanger unit for the suspension and storage of other pairs of pants without having to insert them into the middle of a pack.

Still further, for travel purposes, it is not necessary to remove the several pairs of pants from the hanger unit because it simply may be bodily removed from the clothes rod 12 and the pants folded for travel while their bottoms are still clamped by their respective clips. Such a procedure is possible because the slings 10 are flexible and can be collapsed upon the top of the frame 5.

It is of course to be understood that variations in arrangements and proportions of parts may be made within the scope of the appended claims.

I claim:

1. A garment hanger including a normally horizontal rectangular frame having a pair of spaced parallel side rails, a multiplicity of spaced parallel rods spanning the distance between said side rails and having their ends affixed thereto, a plurality of means removably supported by spaced selected pairs of said spaced parallel rods for suspending garments beneath said frame, said suspending means each comprising at least a pair of spring-biased clips, each of said clips being fitted between a selected pair of said spaced parallel rods and slidably supported thereon for movement in a direction parallel to the axes thereof, each said at least a pair of spring-biased clips being oriented in parallelism with said side rails, and means for suspending said frame from a support located thereabove.

2. The garment hanger of claim 1 in which each said clip is formed from a continuous length of spring wire and includes an intermediately located transverse cylindrical coil spring having a length to pass between a pair of said spaced parallel rods, the ends of said coil spring being bent into configurations defining a pair of depending generally U-shaped clamp arms and a pair of upwardly projecting pinch rings, each of said pinch rings having a diameter sufficiently greater than the spacing between adjacent pairs of said parallel rods as to permit said pinch rings to be supported thereby when the said coil spring and the said clamp arms of said clip are inserted downwardly therebetween.

3. The garment hanger of claim 1 in which the slidable support for each said spring biased clip comprises a pair of coaxial oppositely extending trunnions affixed to said clip and projecting across the tops of said pair of spaced parallel rods in a direction normal to the axes thereof.

4. The garment hanger of claim 1 in which said means for suspending said frame from said support comprises a pair of flexible slings attached to said side rails adjacent the ends thereof.

5. The garment hanger of claim 2 in which said means for suspending said frame from said support comprises a pair of flexible slings attached to said side rails adjacent the ends thereof.

6. The garment hanger of claim 3 in which said means for suspending said frame from said support comprises a pair or flexible slings attached to said side rails adjacent the ends thereof.

7. The garment hanger of claim 5 in which each of said slings is provided with a hook for removable connection with said support.

8. The garment hanger of claim 6 in which each of said slings is provided with a hook for removable connection with said support.

* * * * *